US008858021B2

(12) United States Patent
Kuo

(10) Patent No.: US 8,858,021 B2
(45) Date of Patent: Oct. 14, 2014

(54) LED LIGHTING DEVICE WITH LED LAMPS PROTECTED FROM FALLING OFF

(75) Inventor: Hung-Pin Kuo, Taichung (TW)

(73) Assignee: B&M Optics Co., Ltd., Taichung County (TW)

( * ) Notice: Subject to any disclaimer, the term of this patent is extended or adjusted under 35 U.S.C. 154(b) by 371 days.

(21) Appl. No.: 12/848,687

(22) Filed: Aug. 2, 2010

(65) Prior Publication Data

US 2011/0194279 A1 Aug. 11, 2011

(30) Foreign Application Priority Data

Feb. 6, 2010 (TW) ..... 99202543 U

(51) Int. Cl.

| | |
|---|---|
| ***F21S 2/00*** | (2006.01) |
| ***F21V 29/00*** | (2006.01) |
| ***F21V 17/00*** | (2006.01) |
| ***F21V 3/00*** | (2006.01) |
| ***F21S 8/08*** | (2006.01) |
| ***F21V 17/10*** | (2006.01) |
| ***F21V 17/06*** | (2006.01) |
| ***F21V 5/04*** | (2006.01) |
| *F21Y 101/02* | (2006.01) |
| *F21W 131/103* | (2006.01) |
| *F21Y 105/00* | (2006.01) |

(52) U.S. Cl.

CPC ..... *F21S 8/086* (2013.01); *F21Y 2101/02* (2013.01); *F21V 29/004* (2013.01); *F21V 29/2262* (2013.01); *F21W 2131/103* (2013.01); *F21V 17/005* (2013.01); *F21S 2/005* (2013.01); *F21V 3/00* (2013.01); *F21V 17/102* (2013.01); *F21V 17/06* (2013.01); *F21V 29/006* (2013.01); *F21V 5/04* (2013.01); *F21Y 2105/001* (2013.01)

USPC ..... 362/235; 362/236; 362/238

(58) Field of Classification Search

CPC ..... F21V 19/001–19/0035; F21V 15/00; F21V 17/06; F21V 17/005; F21S 2/005

USPC ..... 362/235–238

See application file for complete search history.

(56) References Cited

U.S. PATENT DOCUMENTS

| | | | | |
|---|---|---|---|---|
| 5,836,676 | A * | 11/1998 | Ando et al. | 362/244 |
| 6,502,956 | B1 * | 1/2003 | Wu | 362/237 |
| 7,226,185 | B2 * | 6/2007 | Dolgin et al. | 362/239 |
| 7,284,871 | B2 * | 10/2007 | Oon et al. | 362/17 |
| 7,331,681 | B2 * | 2/2008 | Pohlert et al. | 362/18 |
| 2009/0237930 | A1 | 9/2009 | Li | |
| 2010/0109499 | A1 * | 5/2010 | Vilgiate et al. | 313/1 |

FOREIGN PATENT DOCUMENTS

| | | |
|---|---|---|
| TW | M305302 | 1/2007 |

* cited by examiner

*Primary Examiner* — Mariceli Santiago
*Assistant Examiner* — Christopher Raabe
(74) *Attorney, Agent, or Firm* — Muncy, Geissler, Olds & Lowe, P.C.

(57) ABSTRACT

A LED lighting device includes a LED module and a diaphanous cover. The LED module includes a circuit board and a plurality of LED lamps. Each of the LED lamps includes a lens unit and a LED package. The lens unit includes a lens body, a frame and at least one pillar. The frame extends from a periphery of the lens body and is mounted on bottom of the circuit board. The pillar extends downward from a bottom surface of the frame. The LED package is mounted in the frame, and has a light emitting surface facing the lens body and a back surface joined to the bottom of the circuit board. The diaphanous cover abuts upward against all distal ends of the pillars of the LED lamps and is secured on the circuit board of the LED module.

13 Claims, 11 Drawing Sheets

LED LIGHTING DEVICE WITH LED LAMPS PROTECTED FROM FALLING OFF

BACKGROUND OF INVENTION

1. Field of Invention

This invention relates to a light emitting diode (herein referred to as LED) lighting device, and more particularly to a LED lighting device which is capable of secure its LED lamps from falling off.

2. Related Prior Art

In general, a conventional LED lighting device, as described in Taiwan Pat. No. M305302, is configured to include a substrate, a number of LED modules mounted on the substrate, a lamp cover upwardly covering all the LED modules, and a plurality of heat sinks for heat dissipation of the LED modules. Each of the LED modules includes a circuit board and a plurality of LED lamps mounted on the circuit board.

Traditionally, to make the LED lighting device, the LED lamps one by one are weld onto the circuit board during the fabrication of the LED modules. The process is relatively heavy and complicated. Moreover, due to possible brittle welds or weak bond, some of the LED lamps may fall off the circuit board and down to the lamp cover after the welding or a short-term use. Thus, the LED lighting device may go from bad to worse and provide uneven or less illumination.

SUMMARY OF INVENTION

It is an object of this invention to provide a LED lighting device which is reasonably easy to assembly.

It is a further object of this invention to provide such a lighting device which includes LED lamps well secured from falling off.

Broadly stated, the present invention is directed to a LED lighting device, comprising a LED module and a diaphanous lamp cover. The LED module includes a circuit board and a plurality of LED lamps mounted on a bottom surface of the circuit board. Each of the LED lamps includes a lens unit and a LED package coupled with the lens unit. The lens unit includes a lens body, a frame and at least one pillar. The frame extends from a periphery of the lens body. The pillar extends downward from a bottom surface of the frame. The LED package is mounted in the frame of the lens unit, and has a light emitting surface facing toward the lens body and a back surface flush with a top surface of the frame. The frame and the LED package together are attached to the bottom surface of the circuit board. The lamp cover abuts upward against all distal ends of the pillars of the LED lamps and is secured on the circuit board to uphold all the LED lamps.

According to the present invention, the pillars are employed to help the lamp cover to support all of the LED lamps. With this simple configuration, all the LED lamps are secured by the lamp cover from falling off the circuit board. The construction of LED lighting device as described above is thus far largely conventional.

Further features and advantages of the present invention will be appreciated by review of the following detailed description of the invention.

BRIEF DESCRIPTION OF DRAWINGS

The invention is illustrated by the accompanying drawings in which corresponding parts are identified by the same numerals and in which.

DETAILED DESCRIPTION OF EMBODIMENTS

Figure 1:
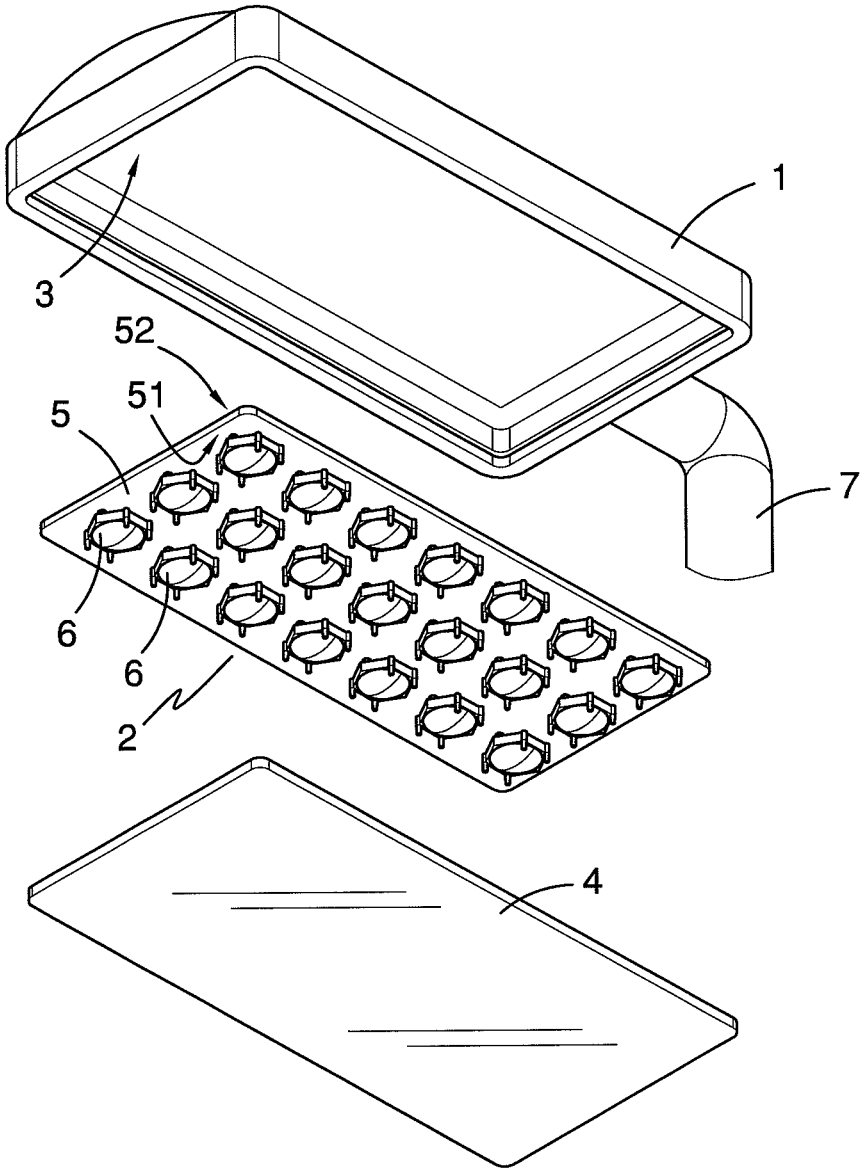
FIG. 1 is an explosive perspective view of a LED lighting device in accordance with a first embodiment of this invention.

Referring now to FIGS. 1-4 of the drawings, a LED lighting device in accordance with a first embodiment of the invention is a street light and includes a housing 1, a LED module 2, a heat sink 3, a diaphanous lamp cover 4 and a pole 7. The LED module 2 and the heat sink 3 are disposed inside the housing 1. The diaphanous cover 4 is secured on the bottom edges of the housing 1 to cover and protect the LED module 2. The LED module 2 includes a circuit board 5 and a plurality of LED lamps 6 mounted on a bottom surface of the circuit board 5.

Figure 3:
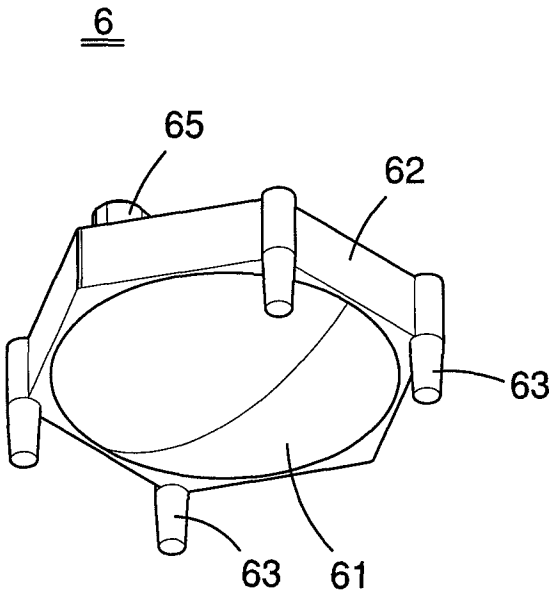
FIG. 3 is a bottom side view of the LED lamp of FIG. 2.
Figure 2:
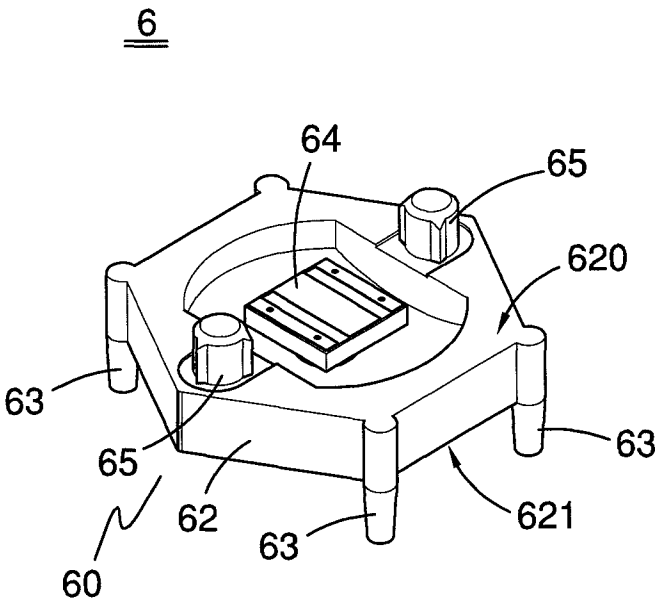
FIG. 2 is a top side view of a LED lamp of the LED lighting device in FIG. 1.

As can be seen in FIGS. 2 and 3, each of the LED lamps 6 includes a lens unit 60 and a LED package 64 mounted in the lens unit 60. The lens unit 60 includes an optical lens body 61, a frame 62 and at least one pillar 63 and at least one positioning post 65. The frame 62 extends from a peripheral of the lens body 61 and has a top surface 620 and a bottom surface 621. In this embodiment, there are four pillars 63 for one lens unit 60. Those pillars 63 equally extend downward from the bottom surface 621 of the frame 62 and share the same height. The LED package 64 is disposed in the frame 62 and has a light emitting surface facing toward the lens body 61 and an opposite back surface being flush with the top surface 620 of the frame 62.

Figure 4:
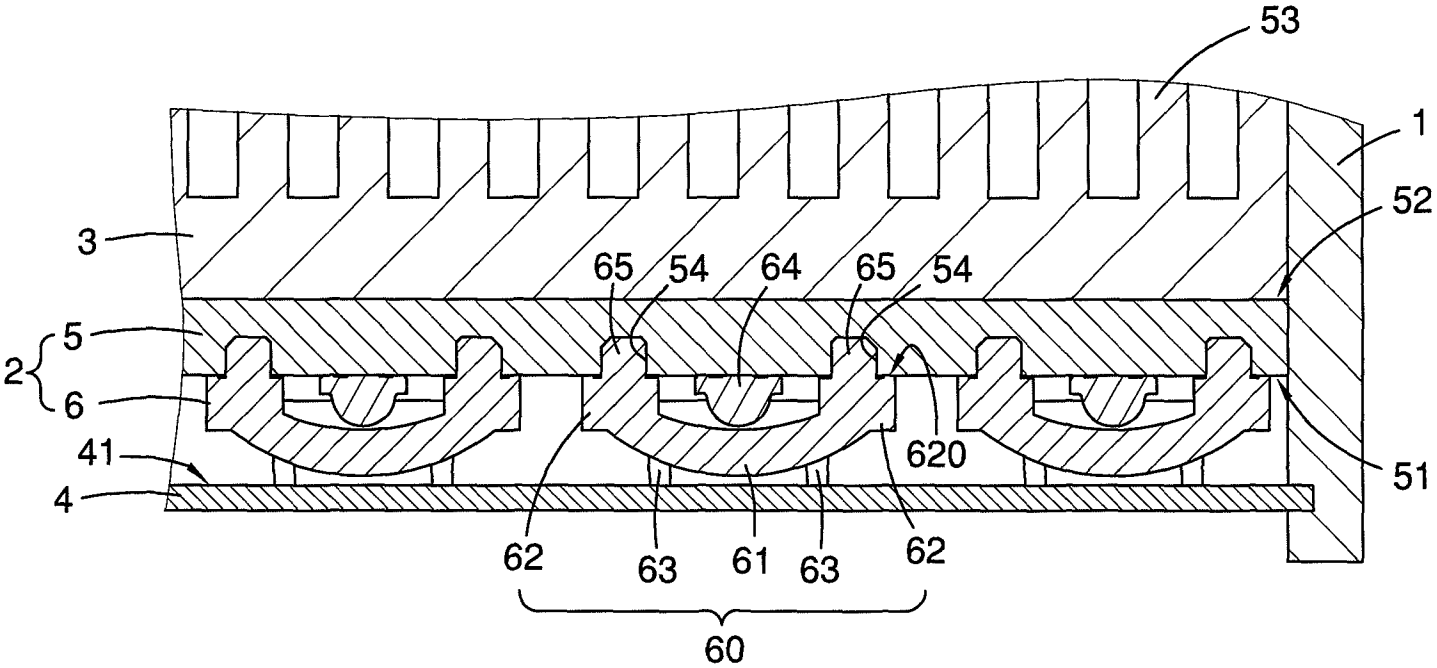
FIG. 4 is a partial cross-sectional view of the LED lighting device of FIG. 1.

As shown in FIG. 4, the LED lamps 6 are placed in between the heat sink 3 and the diaphanous cover 4. Each of the frames 62 has its top surface 620 attached to the bottom surface 51 of the circuit board 5. The LED package 64 is directly welded on the bottom surface 51 of the circuit board 5. In particular, the pillars 63 of each of the lens unit 60 has a distal end with a horizontal level lower than or equal to that of the lens body 61. And, the diaphanous cover 4 is joined to the circuit board 5 via the housing 1. That is, the diaphanous cover 4 abuts upward against all the distal ends of the pillars 63 and thereby keeps the lens unit 60 from falling. Preferably, each of the pillars 63 has its distal end with the horizontal level lower than that of the lens body 61, as shown in FIG. 4, so that a gap can be created between the lens body 61 and the diaphanous cover 4.

On the other hand, each of the posts 65 of the lens units 60 extends upward from the top surface 620 of the frame 62 and be inserted into the corresponding hole 54 of the circuit board 5. In this way, each of the lens units 60 is well positioned and prevented from lateral movement with respect to the LED packages 64. For more reliability, the posts 65 may further be adhered to inner walls of the holes 54 of the circuit board 5 by adhesive. It is noted that the diaphanous cover 4 illustrated in FIG. 4 is indirectly secured onto the circuit board 5 via the bottom edges of the housing 1. However, in other example, the diaphanous cover 4 may be directly screwed onto the circuit board 5.

The heat sink 3 is mounted on the top surface 52 of the circuit board 5 for heat dissipation of the LED module 2. The heat sink 3 includes a number of fins 53 spaced at a distance apart and a heat pipe (not shown) passed through the fins 53 to enhance the dissipation effect.

Turing in detail to FIGS. 5-8, a LED lighting device is illustrated in accordance with a second embodiment. As with LED lighting device of FIG. 4, the LED lighting device of the second embodiment includes a housing 1, a LED module 2*a*, a heat sink 3 and a diaphanous cover 4, except that no posts are formed on top of the LED lamps 6*a* for positioning. However, in order to make sure that each of the LED packages 64*a* can always be in alignment with the corresponding lens unit 60*a*, each of the lens units 60*a* has a receiving room 66*a* dimensioned to match the size of the LED package 64*a*. In such a fashion, the LED package 64*a* can be kept in the receiving room 66*a* from horizontal movement so that the LED packages 64*a* can always be in alignment with the corresponding lens unit 60*a*.

Figure 5:
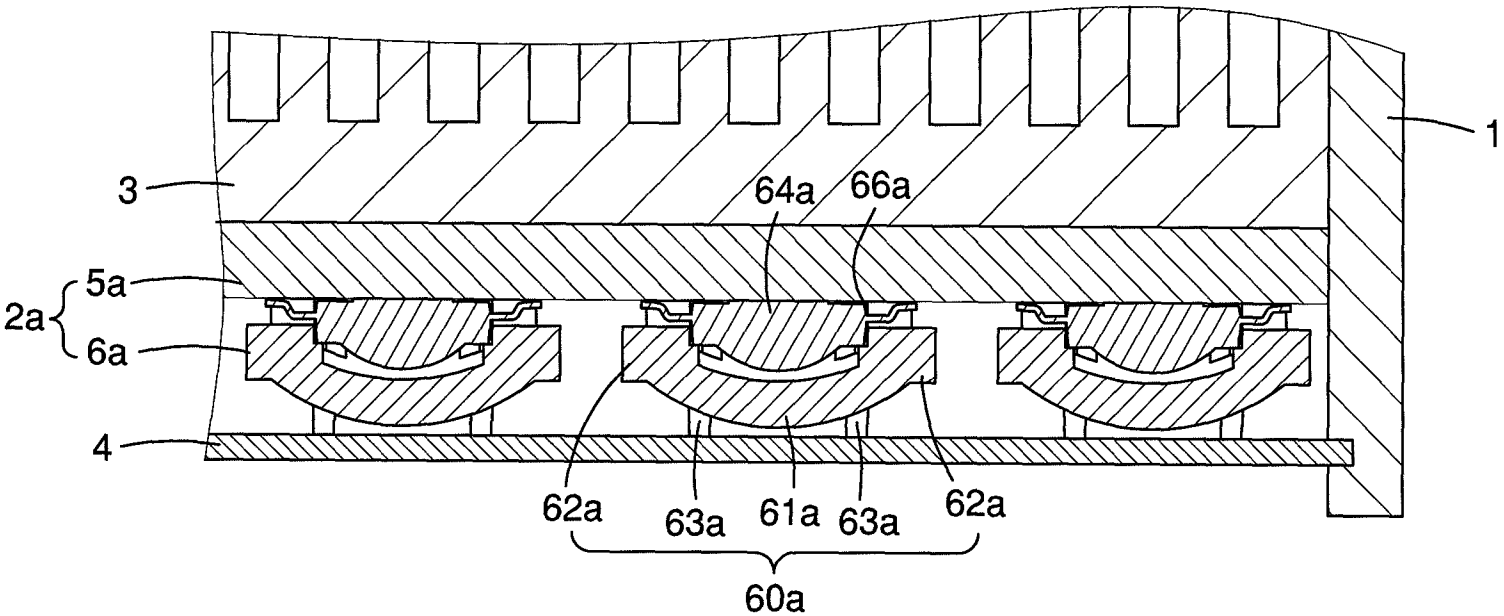
FIG. 5 is a partial cross-sectional view of a LED lighting device in accordance with a second embodiment of this invention.
Figure 7:
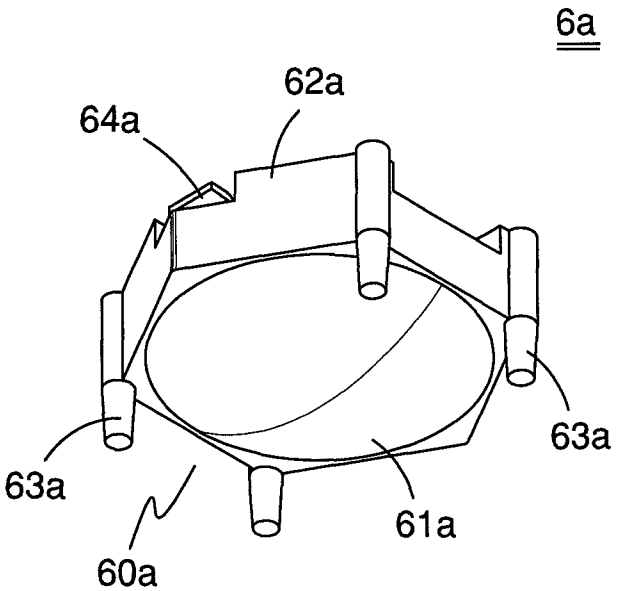
FIG. 7 is a bottom side view of the LED lamp of FIG. 6.
Figure 6:
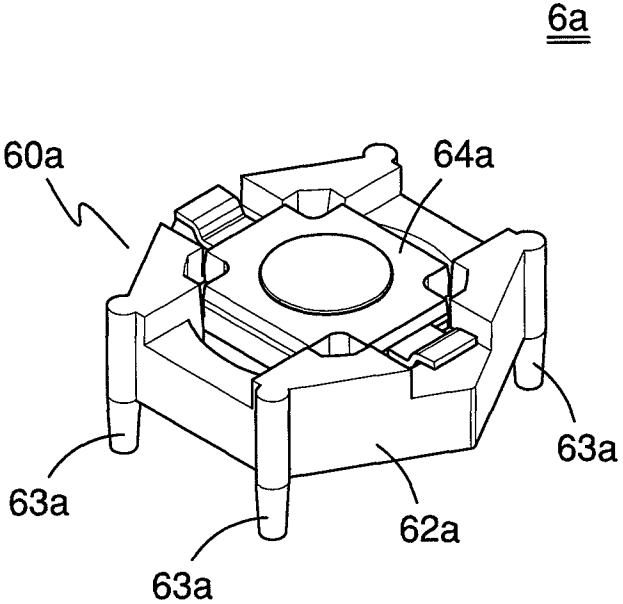
FIG. 6 is a top side view of a LED lamp of the LED lighting device in FIG. 5.
Figure 8:
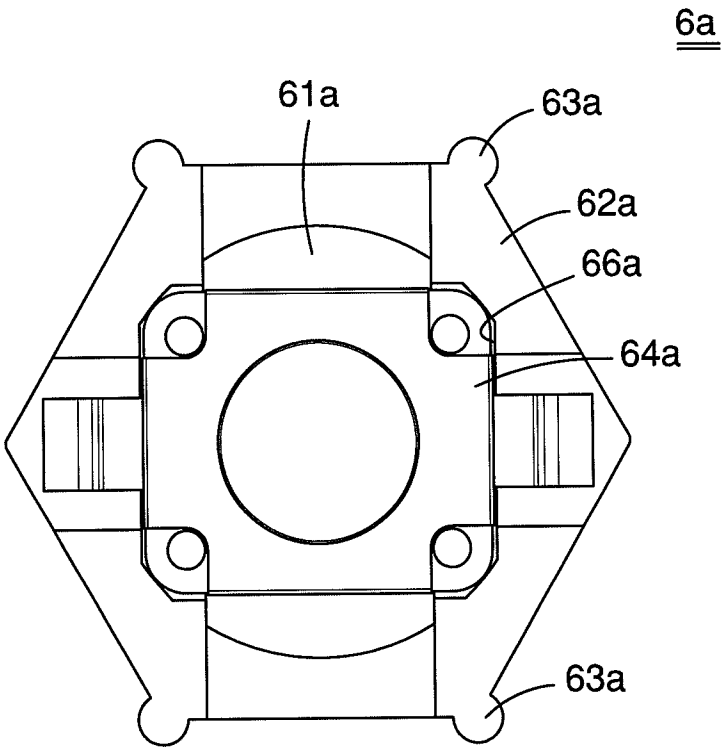
FIG. 8 is a top view of the LED lamp of FIG. 6.

Specifically, as shown in FIGS. 6-7, each of the LED lamps 6*a* includes the LED package 64*a* and the lens unit 60*a*. The lens unit 60*a* includes a lens body 61*a*, the frame 62*a* and at least one pillar 63*a*, without any posts 65 of FIG. 4. It is apparently that the LED package 64*a* of FIG. 6 is much bigger than LED package 64 of FIG. 2 in order to fit into the receiving room 66*a*, as shown in FIGS. 5 and 8. Referring again to FIG. 5, since the LED package 6*a* is first directly welded on the circuit board 5*a* and the lens unit 60*a* is then upwardly engaged with the LED package 64*a*, the lens units 60*a* is well positioned without lateral movement.

Figure 9:
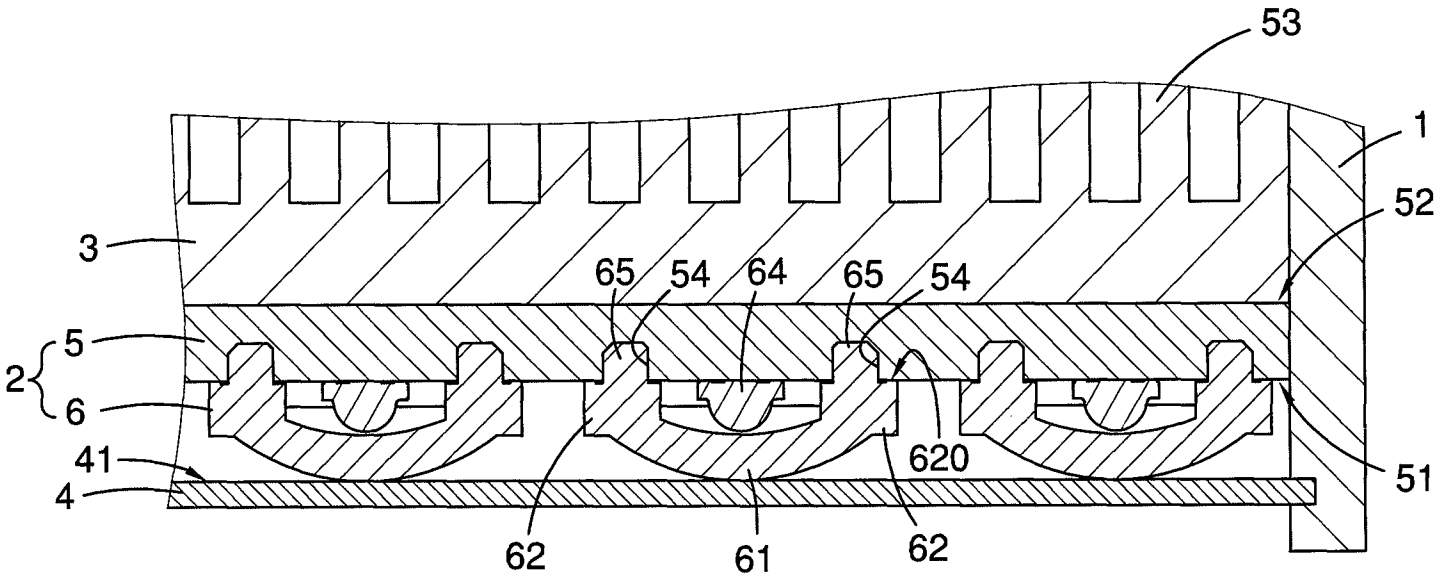
FIG. 9 is a partial cross-sectional view of a LED lighting device in accordance with a third embodiment of this invention.
Figure 10:
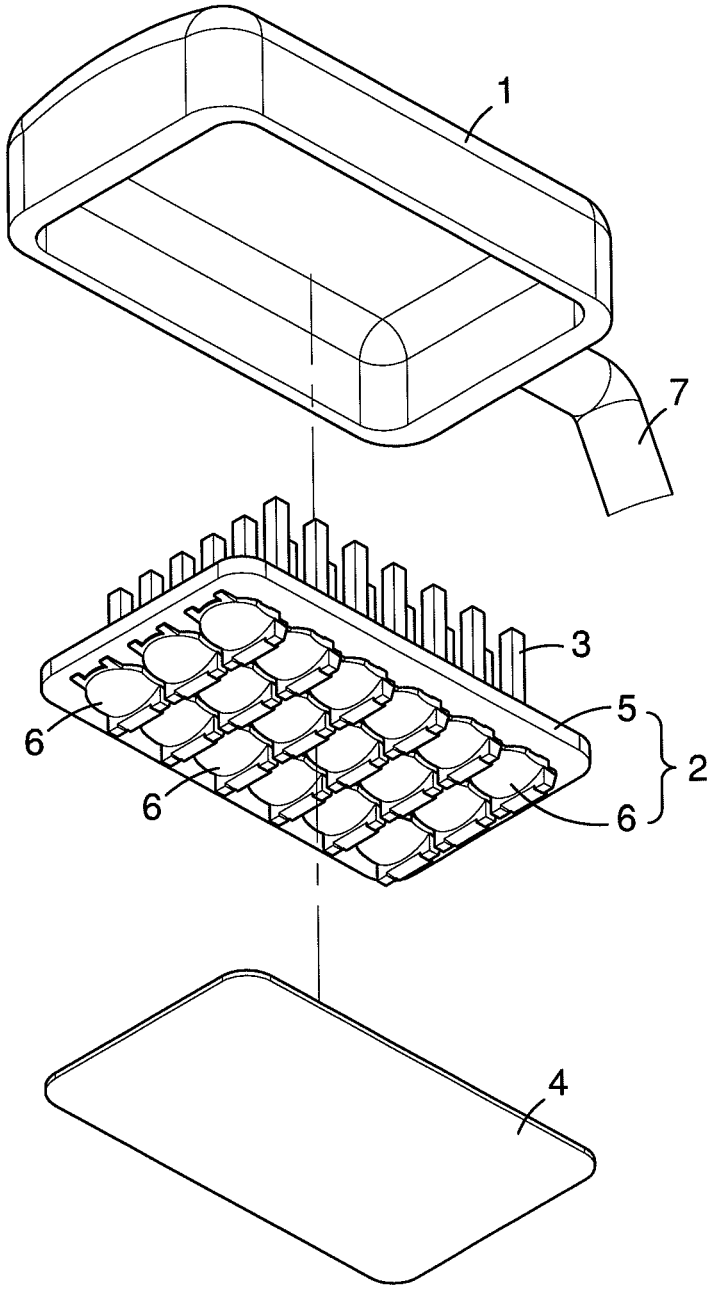
FIG. 10 is an explosive perspective view of a LED lighting device in accordance with a fourth embodiment of this invention.
Figure 12:
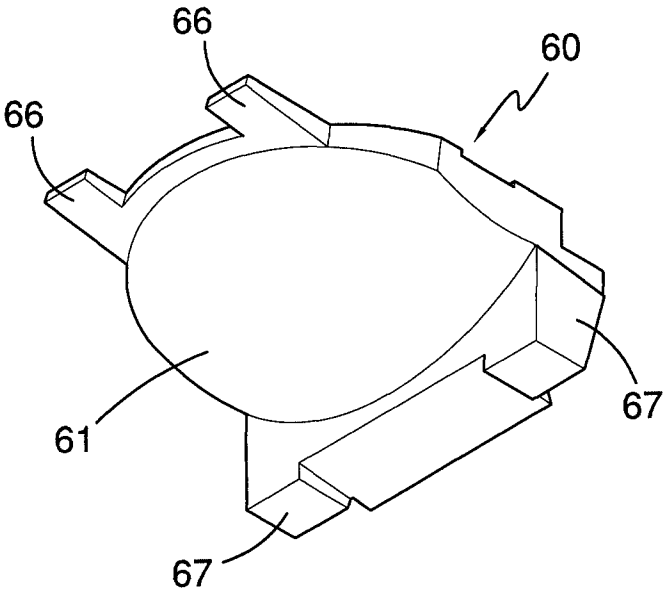
FIG. 12 is a bottom side view of the lens unit of FIG. 10.

FIG. 9 provides a partial cross-sectional view of a LED lighting device in a third embodiment. The third embodiment is similar to the first embodiment of FIGS. 1-4, except that no pillars are included. However, the diaphanous cover 4 abuts upward against all the lowest portions 61 of the LED lamps 6 to keep the LED lamps 6 from falling off.

With reference to FIGS. 10-14 of the drawings, a LED lighting device in accordance with a fourth embodiment of the invention is disclosed and includes a housing 1, a LED module 2, a heat sink 3, a diaphanous lamp cover 4 and a pole 7. The LED module 2 and the heat sink 3 are disposed inside the housing 1. The diaphanous cover 4 is secured on the bottom edges of the housing 1 to cover and protect the LED module 2. The LED module 2 includes a circuit board 5 and a plurality of LED lamps 6 mounted on a bottom surface of the circuit board 5.

Figure 13:
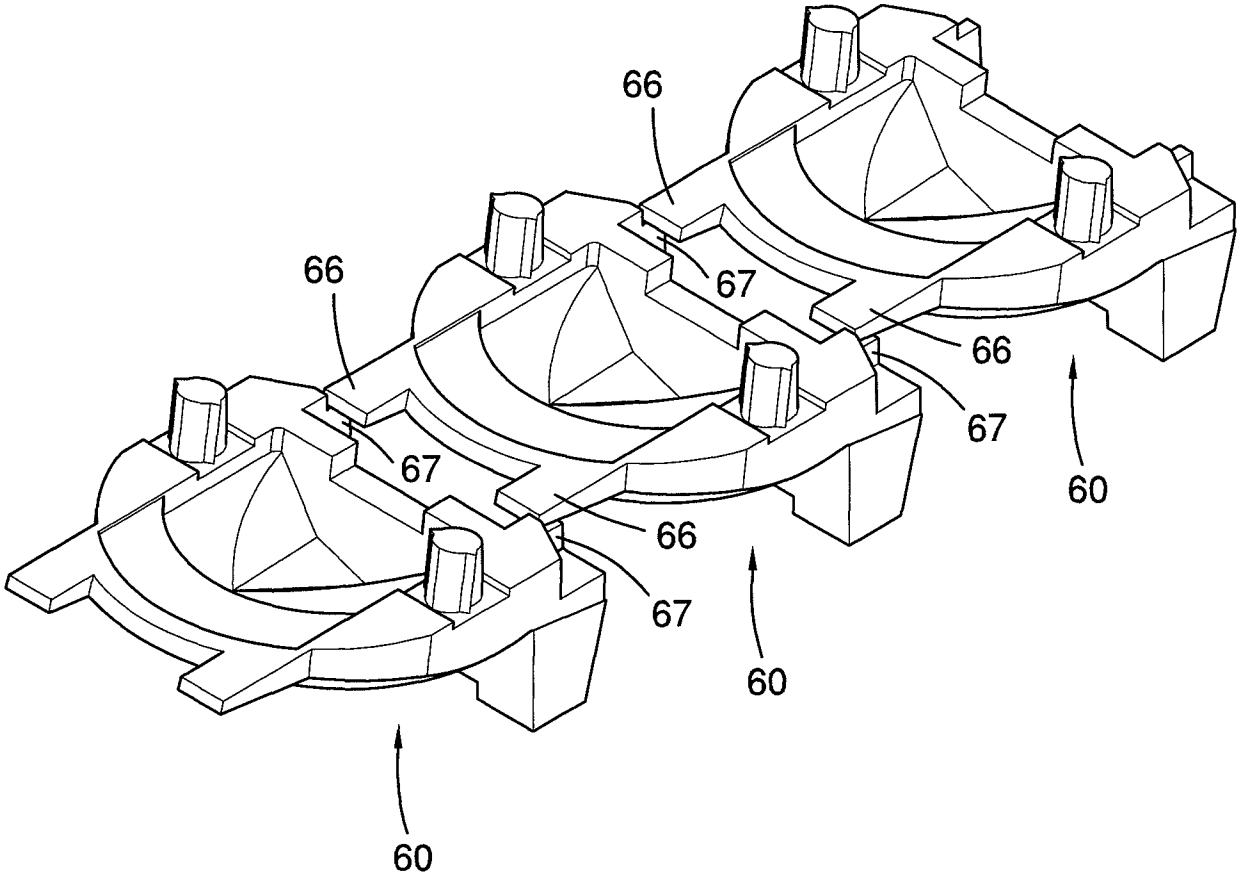
FIG. 13 illustrates three interlocked lens units in a line according to the fourth embodiment.
Figure 14:
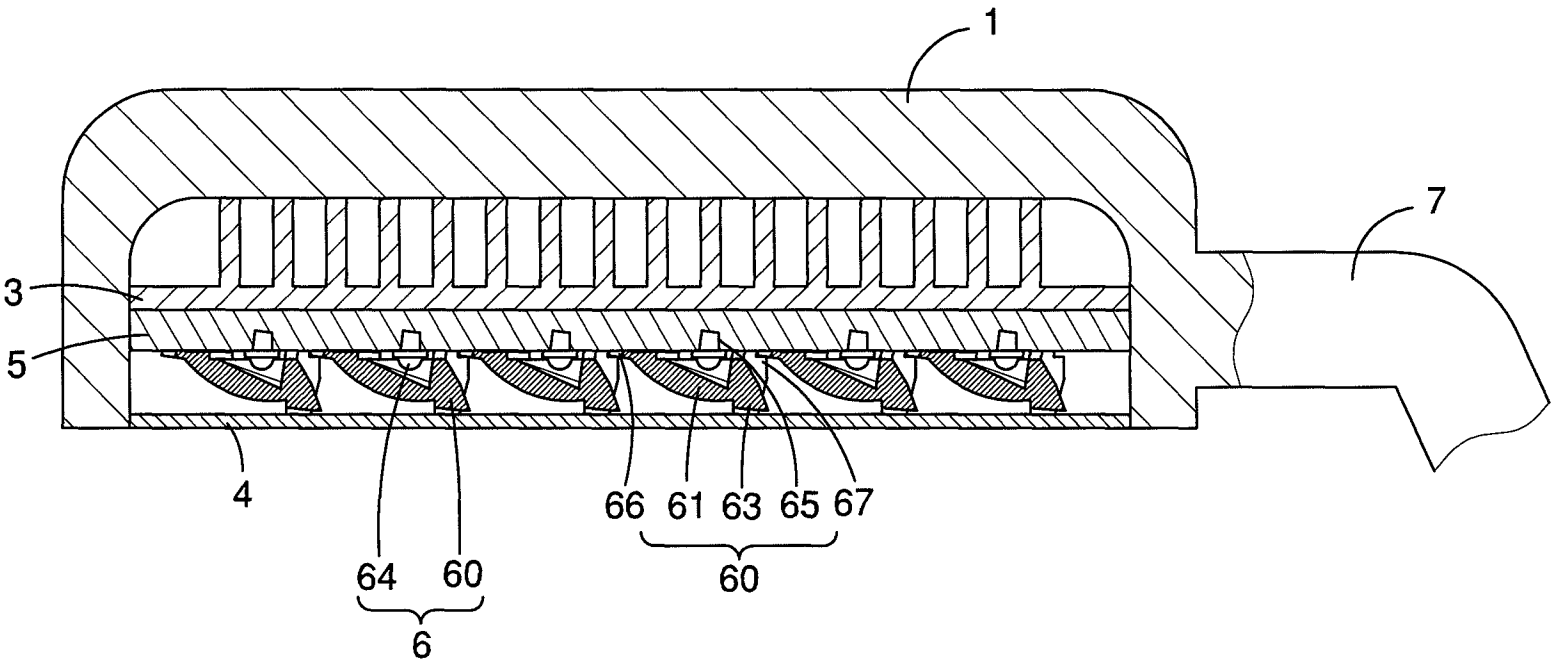
FIG. 14 is a cross-sectional view of the LED lighting device of FIG. 10.

Each of the LED lamps 6 includes a lens unit 60 and a LED package 64 mounted in the lens unit 60, as shown in FIG. 14. As with lens unit of FIGS. 2 and 3, the lens unit 60 of FIGS. 11 and 12 includes an optical lens body 61, a frame 62 and at least one pillar 63 and at least one positioning post 65. The frame 62 extends from a peripheral of the lens body 61 and has a top surface 620 to be joined with a circuit board. In this embodiment, there are only two pillars 63 for one lens unit 60. Those pillars 63 equally extend downward from a bottom surface of the frame 62 and share the same height. The LED package 64 is disposed in the frame 62 and has a light emitting surface facing toward the lens body 61 and an opposite back surface being flush with the top surface 620 of the frame 62. Different from the first embodiment, the lens unit 60 of the fourth embodiment further includes at least one front protrusion 66 and at least one rear supporting portion 67. The front protrusion extends from a front side of the frame 62 while the rear supporting portion is formed on a rear side of the frame 62 where the pillars 63 are located. As best seen in FIG. 13, when three lens units 60 are arranged in a line, the front protrusion 66 of the middle lens unit 60 is upheld by an adjacent rear supporting portion 67 of the front lens unit 60; and the rear supporting portion 67 of the middle lens unit 60 upholds an adjacent front protrusion 66 of the rear lens unit 60. In such a manner, as illustrated in FIG. 14, those lens units 60 can be easily assembled onto the circuit board 5 and therefore interlocked and well-secured between the circuit board 5 and the diaphanous cover 4.

As with the LED lamps 6 of FIG. 4, the LED lamps 6 of FIG. 14 are placed in between the heat sink 3 and the diaphanous cover 4. Each of the frames 62 is mounted on bottom of the circuit board 5. The LED package 64 is directly welded on the bottom surface of the circuit board 5. The pillars 63 of each of the LED lamps 6 has a distal end with a horizontal level lower than or equal to that of the lens body 61. And, the diaphanous cover 4 is joined to the circuit board 5 via the housing 1. That is, the diaphanous cover 4 abuts upward against all the distal ends of the pillars 63 and thereby keeps the lens unit 60 from falling.

Figure 11:
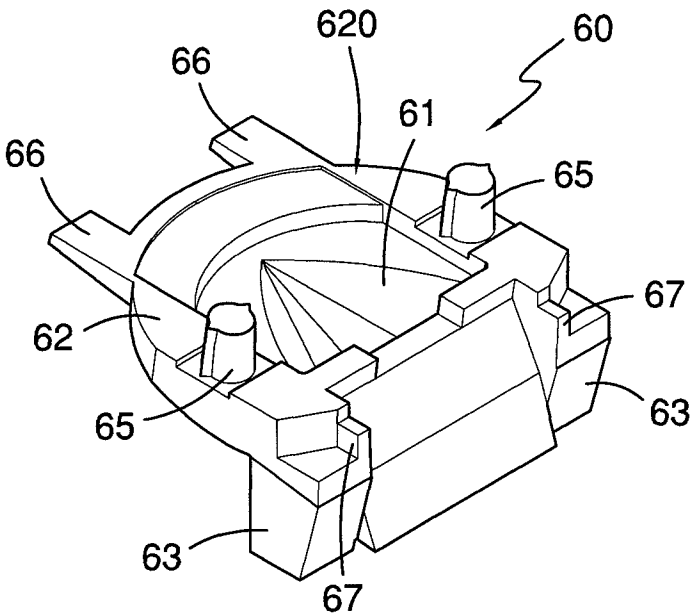
FIG. 11 is a top side view of a lens unit of LED lamp of the LED lighting device in FIG. 10.

Referring to FIGS. 11 and 14, the posts 65 of the lens units 60 extend upward from the top surface 620 of the frame 62 to be inserted into the corresponding hole 54 of the circuit board 5. In this way, each of the lens units 60 is well positioned and prevented from lateral movement with respect to the LED packages 64. For more reliability, the posts 65 may further be adhered to inner walls of the holes 54 of the circuit board 5 by adhesive. The heat sink 3 is mounted on top of the circuit board 5 for heat dissipation of the LED module 2.

It will be appreciated that although a particular embodiment of the invention has been shown and described, modifications may be made. It is intended in the claims to cover such modifications which come within the spirit and scope of the invention.

The invention claimed is:

1. A one-piece LED lens having a body, multiple pillars and two positioning posts, the pillars, two positioning posts and the body integrally made from the same material, the body having an optical axis, a top surface and a bottom surface opposite to the top surface, the top surface being for a light-incident surface, the bottom surface being for a light-exit surface, wherein each of the pillars elongates downward continuously from a periphery of the body along a direction parallel to the optical axis direction, and the pillars has distal ends lower than the bottom surface, and wherein the two positioning posts extend upward from the periphery of the body along a direction parallel to the optical axis direction, the two positioning posts are oppositely located nearby the top surface of the body.

2. The one-piece LED lens of claim 1, wherein the LED lens comprising two pillars.

3. The one-piece LED lens of claim 1, further having a receiving room defined by the body for reception of a LED package.

4. The one-piece LED lens of claim 1, further comprising at least one front protrusion extending from a front side of the periphery of the body along a direction perpendicular to the optical axis direction and at least one rear supporting portion formed on a rear side of the periphery of the body opposite to the front side and corresponding to the front protrusion; wherein the front protrusion of the lens is capable of being upheld by an adjacent rear supporting portion of another adjacent lens and the rear supporting portion of the lens is capable of upholding an adjacent front protrusion of yet another lens.

5. A LED lighting device comprising a housing, a LED module disposed inside of the housing and a diaphanous cover covering the LED module and mounted on the housing, wherein the LED module includes a circuit board and a plurality of LED lamps; wherein each LED lamp including:

a one-piece LED lens, having a body, multiple pillars and two positioning posts, the pillars, two positioning posts and the body integrally made from the same material, the body having an optical axis, a top surface and a bottom surface opposite to the top surface, the top surface being for a light-incident surface, the bottom surface being for a light-exit surface, the top surface of the body being against a bottom surface of the circuit board, the pillars elongating downward continuously from a periphery of the body along a direction parallel to the optical axis direction, the pillars having distal ends lower than the bottom surface of the body, the two positioning posts extending upward from the periphery of the body along a direction parallel to the optical axis direction, the two positioning posts oppositely located nearby the top surface of the body and inserting into two corresponding holes of the circuit board ; and a LED package, having a light emitting surface facing the top surface of the body and a back surface opposite to the light emitting surface mounted onto the bottom surface of the circuit board;

wherein the diaphanous cover has a surface in contact with all the distal ends of the pillars of the one-piece LED lenses and sustains the one-piece LED lenses.

6. The LED lighting device of claim 5, wherein each of the one-piece LED lens has a receiving room defined by the body to receive the LED package; the receiving room is dimensioned to match the size of the LED package such that the LED package can be kept in the receiving room from horizontal movement.

7. The LED lighting device of claim 5, wherein each of the one-piece LED lens further comprises at least one front protrusion extending from a front side of the periphery of the body along a direction perpendicular to the optical axis direction and at least one rear supporting formed on a rear side of the periphery of the body opposite to the front side thereof and corresponding to the front protrusion; and wherein the front protrusion of the one-piece LED lens is capable of being upheld by an adjacent rear supporting portion of another adjacent lens and the rear supporting portion of the lens is capable of upholding an adjacent front protrusion of yet another lens.

8. The LED lighting device of claim 5, further comprising a heat sink disposed inside of the housing and in contact with a top surface of the circuit board opposite to the bottom surface of the circuit.

9. A LED lighting device comprising a housing, a LED module disposed inside of the housing and a diaphanous cover covering the LED module and mounted on the housing, wherein the LED module includes a circuit board and a plurality of LED lamps; wherein each LED lamp including:

a LED lens, having a body and two positioning posts, two positioning posts and the body integrally made from the same material, the body having an optical axis, a top surface and a bottom surface opposite to the top surface, the top surface being for a light-incident surface, the bottom surface being for a light-exit surface, the top being against a bottom surface of the circuit board, the two positioning posts extending upward from the periphery of the body along a direction parallel to the optical axis direction, the two positioning posts oppositely located nearby the top surface of the body and inserting into two corresponding holes of the circuit board; and a LED package, having a light emitting surface facing the top surface of body and a back surface opposite to the light emitting surface mounted onto the bottom surface of the circuit board;

wherein the diaphanous cover has a surface in contact with all of the LED lenses and sustains the LED lenses.

10. The LED lighting device of claim 9, wherein the lens further includes multiple pillars elongating downward continuously from a periphery of the body along a direction parallel to the optical axis direction; wherein the pillars and the body are integrally made from the same material; and wherein the surface of the diaphanous cover is in contact with all distal ends of the pillars of the LED lenses.

11. The LED lighting device of claim 10, wherein the lens further comprises at least one front protrusion extending from a front side of the periphery of the body along a direction perpendicular to the optical axis direction and at least one rear supporting formed on a rear side of the periphery of the body opposite to the front side and corresponding to the front protrusion; and wherein the front protrusion of the lens is capable of being upheld by an adjacent rear supporting portion of another adjacent lens and the rear supporting portion of the lens is capable of upholding an adjacent front protrusion of yet another lens.

12. The LED lighting device of claim 10, wherein each of the LED lens has a receiving room defined by the body to receive the LED package; the receiving room is dimensioned to match the size of the LED package such that the LED package can be kept in the receiving room from horizontal movement.

13. The LED lighting device of claim 10, further comprising a heat sink disposed inside of the housing and in contact with a top surface of the circuit board opposite to the bottom surface of the circuit.

* * * * *